US006210054B1

(12) United States Patent
Adams et al.

(10) Patent No.: US 6,210,054 B1
(45) Date of Patent: Apr. 3, 2001

(54) METHOD FOR APPLYING PRINTER REGISTRATION MARKS TO LINERLESS LABEL STOCK

(75) Inventors: Matthew T. Adams, Cincinnati; Kevin Girard Conwell; William V. Yeager, both of Fairfield, all of OH (US)

(73) Assignee: Intermec IP Corp., Woodland Hills, CA (US)

( * ) Notice: Subject to any disclaimer, the term of this patent is extended or adjusted under 35 U.S.C. 154(b) by 0 days.

(21) Appl. No.: 09/368,250

(22) Filed: Aug. 3, 1999

(51) Int. Cl.[7] ..... B41J 15/02
(52) U.S. Cl. ..... 400/621; 101/288
(58) Field of Search ..... 101/288, 485, 101/226, 227; 400/621, 621.2; 156/277, 289

(56) References Cited

U.S. PATENT DOCUMENTS 5,487,915 1/1996 Russ et al. .
5,518,762 5/1996 Soltysiak et al. .
5,560,293 * 10/1996 Boreali et al. ..... 101/288
5,578,352 * 11/1996 Smith ..... 428/40.1
5,656,116 8/1997 Soltysiak .
5,713,679 * 2/1998 Taylor ..... 400/621
5,749,990 * 5/1998 Rello et al. ..... 156/187
5,750,192 5/1998 Smith .
5,760,414 6/1998 Taylor .

* cited by examiner

*Primary Examiner*—Ren Yan
(74) *Attorney, Agent, or Firm*—O'Melveny & Myers LLP

(57) ABSTRACT

A web of linerless label stock having a recording layer on a top surface and an adhesive layer on a bottom surface is provided with registration marks printed onto the adhesive layer. The linerless label stock further includes perforation lines in correspondence with the registration marks. The spacing between adjacent ones of the registration marks may be selected to correspond with desired width of the linerless labels. To process the linerless label stock, the web of linerless label stock is first sent through a flexographic printing system where registration marks are applied to the adhesive layer at constant intervals. After the registration marks are applied, the web of label stock passes through a die station that perforates the web in correspondence with the registration marks. The web is then wound up into finished rolls to be placed on a thermal printer.

20 Claims, 1 Drawing Sheet

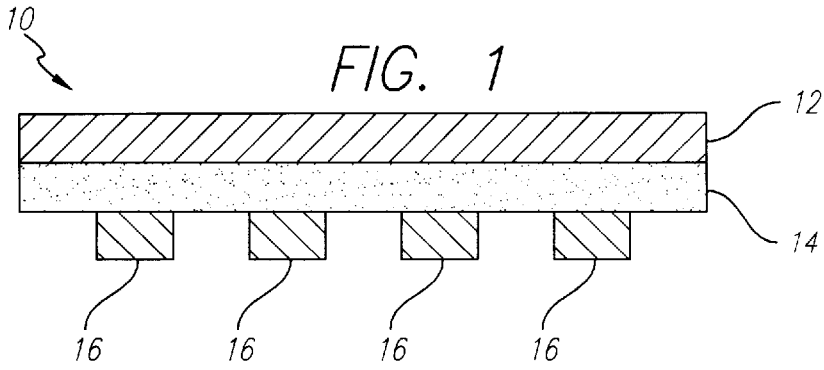
FIG. 1
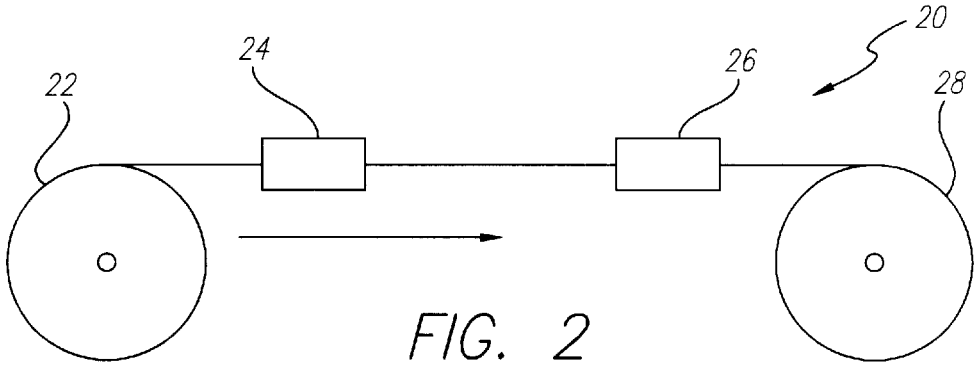
FIG. 2
FIG. 3A
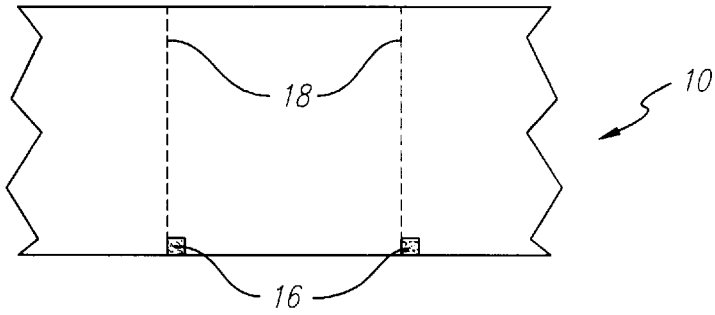
FIG. 3B
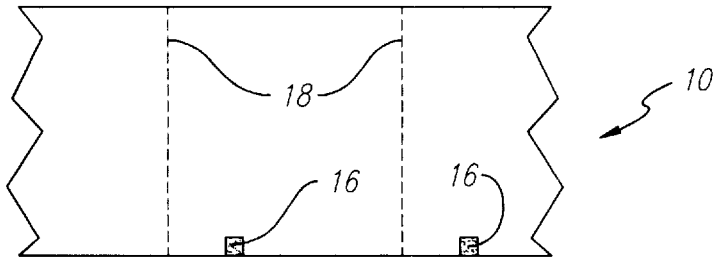

METHOD FOR APPLYING PRINTER REGISTRATION MARKS TO LINERLESS LABEL STOCK

BACKGROUND OF THE INVENTION

1. Field of the Invention

The present invention relates generally to printer registration marks, and more specifically to a method for applying printer registration marks to linerless label stock.

2. Description of Related Art

Linerless media and labels are becoming increasingly popular in the label producing industry because of the many advantages over their linered counterparts. A linerless label stock is typically a continuous roll of direct thermal label or tag stock (e.g., paper, film, or combination) having a pressure sensitive (i.e., self-stick) adhesive on the backside without a silicone coated release liner. Linerless label stock is advantageous over traditional linered media since there is no release liner to dispose of, and as a result, a greater amount of media may be included in a same size roll as that of linered media. In view of the growing popularity of linerless media, methods to improve the production and throughput rates of linerless labels have become essential.

The linerless label stock is transported through a printing system including a printer such as a thermal transfer or direct thermal printer. In a thermal transfer printer, the linerless label stock is transferred through the print region of the printer along with a thermal transfer ribbon. The thermal transfer ribbon is impregnated with a thermally sensitive chemical that reacts in the presence of heat applied by print elements of the print region. The chemical is then transferred onto the linerless label stock in the form of printed indicia. In a direct thermal printer, the thermally sensitive chemical is impregnated directly into the linerless label stock, thereby eliminating the need for a separate thermal transfer ribbon. Both types of printing are collectively referred to herein as thermal printing. Under either method of thermal printing, the thermal printer creates the printed indicia by selectively controlling individual ones of the print elements. The printed indicia may take the form of individual labels provided on designated sections of the linerless label stock with a gap defined between adjacent ones of the labels.

Unlike linered labels that are pre-cut to size, the individual labels of linerless label stock must be separated after printing. Some printers for linerless media use an automatic rotary or guillotine type cutter knife mechanism to separate the labels from the continuous label stock. These cutter mechanisms can be costly and difficult to keep clean of adhesive residue. Other printers use a manual tear bar, which is a stationary blade that is used to cut the label stock by manually pulling the media across the tear bar. These tear bars do not always give a consistently clean tear across the label stock. Also, the tear bar may have a serrated knife that can pose a risk of serious injury to users of the printer. Thus, a preferred method to produce individual labels is to pre-cut a perforation line into the label stock. The perforation line allows for easy, clean separation of individual labels or tags. The perforation lines must be recognized by the printer so that the printed indicia can be aligned to the predetermined labels defined by the perforation lines without extending over the perforations lines. Thus, it is known to include printer registration marks onto a roll of linerless label stock disposed in correspondence with the perforation lines. The registration marks may be detected by optical sensors included within the printer used to print indicia upon the linerless label stock.

A known way to apply registration marks to linerless media is to print the marks onto the back of the label stock before the adhesive is applied to the label stock. Linerless media manufacturers typically apply the adhesive coating to large sheets of the media that are later cut down to the desired width dimensions of the linerless label stock and wound onto rolls or spindles. The adhesive coating equipment is generally large and expensive, and it is thus impractical for small scale label manufactures or printer end-users to perform. Another drawback of having registration marks pre-printed on the linerless media prior to applying the adhesive layer is that it limits the eventual printing of labels to the particular dimensions determined by the registration marks. An alternative method is to place registration marks on the facing surface of the label stock. This is undesirable because the registration marks have the potential to interfere with the printed indicia, such as barcodes, that are printed onto the labels. Thus, there is a need for a method to apply printer registration marks onto the backs of the linerless labels after the adhesive has been applied.

Therefore it is an object of this invention to provide a process for applying printer registration marks to linerless label stock so that the resulting labels can be produced in a fast, efficient manner. It is further an object of this invention to provide an economical process for applying printer registration marks onto linerless label stock.

SUMMARY OF THE INVENTION

In accordance with the present invention, a web of linerless label stock having a recording layer on a top surface and an adhesive layer on a bottom surface is provided with registration marks printed onto the adhesive layer. The linerless label stock further includes perforation lines in correspondence with the registration marks. The spacing between adjacent ones of the registration marks may be selected to correspond with desired width of the linerless labels. To process the linerless label stock, the web of linerless label stock is first sent through a flexographic printing system where registration marks are applied to the adhesive layer at constant intervals. After the registration marks are applied, the web of label stock passes through a die station that perforates the web in correspondence with the registration marks. The web is then wound up into finished rolls to be placed on a thermal printer.

A more complete understanding of the method for applying printer registration marks to linerless label stock will be afforded to those skilled in the art, as well as a realization of additional advantages and objects thereof, by a consideration of the following detailed description of the preferred embodiment. Reference will be made to the appended sheets of drawings that will first be described briefly.

BRIEF DESCRIPTION OF THE DRAWINGS

FIG. 1 is an enlarged cross-section of linerless media;

FIG. 2 is block diagram of a linerless media converting process in accordance with the present invention; and FIGS. 3A–3B are plan views of finished linerless label stock.

DETAILED DESCRIPTION OF THE PREFERRED EMBODIMENT

The present invention satisfies the need for a process to apply printer registration marks onto linerless media without having to coat the media with adhesive after applying the marks. This is accomplished by applying the printer registration marks over the already present adhesive layer on the linerless label stock. In the detailed description that follows, like element numerals are used to describe like elements illustrated in one or more of the figures.

Referring first to FIG. 1, a cross-section of linerless label stock 10 in accordance with the present invention is shown. The linerless label stock 10 has two layers including an adhesive layer 14 and a recording layer 12. As described above, the adhesive layer 14 is applied by adhesive coating equipment onto large sheets of the recording layer 12. The recording layer 12 provides a surface onto which indicia may be printed, such as alphanumeric text, graphics, symbols, and barcodes. The top surface of the recording layer 12 may further be coated with a release material so that the adhesive layer 14 will not form a permanent bond to the recording layer 12 when the linerless label stock 10 is wound onto rolls. In the preferred embodiment, Fasson 10118 label stock is used. The linerless label stock 10 further includes registration marks 16 provided on the adhesive layer 14. It should be appreciated that the side view of the linerless label stock 10 is not necessarily drawn to scale, but rather the dimensions of the registration marks 16 are distorted for ease of explanation of the present invention.

FIG. 2 shows a first embodiment of the process for applying registration marks, wherein an assembly 20 is set up for the preparation of the linerless label stock 10. The initial web of linerless label stock 22, including a recording layer 12 and an adhesive layer 14, is sent through a sensor marking station 24 where the printer registration mark 16 is applied to the adhesive backside 14 of the label stock. The spacing between adjacent printer registration marks is selected to correspond with a desired size of the linerless labels that are ultimately produced.

The sensor marking station 24 may comprise a flexographic press, such as a Mark Andy 830 flexographic press. The label stock 10 is fed into the press such that the adhesive layer 14 is facing away from the central impression cylinder and die anvil. The idler and nip pressure rollers on the press are wrapped with silicone tape that can come into direct contact with the adhesive layer 14 without sticking. The ink used for this application is a water based black pigment system, preferably Wagers 20708 Eyemark Black. The optical density (OD) of the registration mark 16 is typically recommended to be no less than 1.2 OD to be compatible with the printer's reflective sensor. The size and location requirements of the registration mark 16 will depend on the specific printer model or other application method in addition to 10 sensor location. It should be appreciated that other methods of applying the registration marks could also be used, including offset, rotogravure, hot stamp, ink jet, or silk screen printing.

After the registration mark 16 has been applied to the label stock 10, it is passed through a die station 26 which perforates the media in correspondence with each registration mark 16. The perforation lines are cut across the width of the label stock and are formed by a perforating blade. The perforated label stock with registration marks 16 is then wound onto a finished roll 28 where it is stored for use on a printer such as a thermal printer. It should be appreciated that the perforation lines 18 may overlap with the registration marks 16 (as shown in FIG. 3A), or the perforation lines 18 may be offset from the registration marks 16 by a predetermined distance (as shown in FIG. 3B).

In the preferred embodiment, label stock 1.5 inches wide is used and a registration mark 16 is placed every 1.5 inches along the lengthwise dimension of the label stock. The minimum length of the registration mark 16, for use with the preferred printer, is approximately 0.2 inches long in the machine direction (i.e., feed direction) and approximately 0.4 inches wide. It should be appreciated that the width of the registration mark 16 could span the entire label stock (e.g., 1.5 inches in the preferred embodiment); however, it is preferred to use the minimum width because it does not cover as much adhesive. This is important because the ink, when printed directly on the pressure sensitive adhesive, causes the loss of a significant amount of tack, creating a "dry edge" at the leading and trailing edges of a label which could cause adhesion problems. In addition, a smaller mark is generally preferred because there is less black ink showing through the label which decreases the background reflectance required for high symbol contrast on bar codes.

It should be appreciated that the order of the sensor marking station 24 and the die station 26 can also be reversed. This way, the label stock 10 is first perforated by the die station 26 and then the registration mark is applied by the sensor marking station 24. The label stock is then wound into finish roll 28.

Having thus described a preferred embodiment of a method and apparatus for applying printer registration marks to linerless label stock, it should be apparent to those skilled in the art that certain advantages of the aforementioned system have been achieved. It should also be appreciated that various modifications, adaptations, and alternative embodiments thereof may be made within the scope and spirit of the present invention. The invention is further defined by the following claims.

What is claimed is:

1. A method of processing a web of linerless label stock having a recording surface on a first side thereof and an adhesive layer on a second side thereof, comprising the steps of:

driving said web of linerless labels stock in a first direction;

printing plural registration marks over said adhesive layer spaced apart by a predetermined separation distance;

cutting plural perforation lines into said label stock in correspondence with said plural registration marks; and winding said linerless label stock into a roll.

2. The method according to claim 1, wherein said printing step precedes said cutting step, and said cutting step further comprises cutting said plural perforation lines in an overlapping manner with respective ones of said plural registration marks.

3. The method according to claim 1, wherein said printing step precedes said cutting step, and said cutting step further comprises cutting said plural perforation lines in an offset manner with respective ones of said plural registration marks.

4. The method according to claim 1, wherein said cutting step precedes said printing step, and said printing step further comprises printing said plural registration marks substantially centered on respective ones of said plural perforation lines.

5. The method according to claim 1, further comprising the step of selecting a desired spacing between adjacent ones of the plural registration marks.

6. A web of linerless label stock processed in accordance with the method of claim 1.

7. A linerless label media web having a first recording side and a second adhesive side having an adhesive material disposed thereon, wherein plural registration marks are provided on said second side substantially covering a portion of said adhesive material, and plural perforation lines are provided in said web in correspondence with respective ones of said registration marks, said web being made by the process of:

driving said web of linerless labels stock in a first direction;

printing said plural registration marks over said adhesive material spaced apart by a predetermined separation distance;

cutting said plural perforation lines into said web in correspondence with said plural registration marks; and winding said web onto a roll.

8. The linerless label media web of claim 7, wherein said predetermined separation distance is at least 1.5 inches.

9. The linerless label media web of claim 7, wherein said printing step further comprises printing said plural registration marks using a water-based carbon black pigment.

10. The linerless label media web of claim 7, wherein said printing step further comprises printing said plural registration marks with a width measured across said web of approximately 0.4 inches.

11. The linerless label media web of claim 7, wherein said printing step further comprises printing said plural registration marks with a length measured along said web of approximately 0.2 inches.

12. The linerless label media web of claim 7, wherein said printing step precedes said cutting step, and said cutting step further comprises cutting said plural perforation lines in an overlapping manner with respective ones of said plural registration marks.

13. The linerless label media web according to claim 7, wherein said printing step precedes said cutting step, and said cutting step further comprises cutting said plural perforation lines in an offset manner with respective ones of said plural registration marks.

14. The linerless label media web according to claim 7, wherein said cutting step precedes said printing step, and said printing step further comprises printing said plural registration marks substantially centered on respective ones of said plural perforation lines.

15. The linerless label media web according to claim 7, further comprising the step of selecting a desired spacing between adjacent ones of the plural registration marks.

16. An apparatus for processing a web of linerless label stock having a recording surface on a first side thereof and an adhesive layer on a second side thereof, comprising:

means for driving said web of linerless labels stock in a first direction;

means for printing plural registration marks over said adhesive layer spaced apart by a predetermined separation distance; and means for cutting plural perforation lines into said label stock in correspondence with said plural registration marks.

17. The apparatus according to claim 16, wherein said cutting means cuts said plural perforation lines in an overlapping manner with respective ones of said plural registration marks.

18. The apparatus according to claim 16, wherein said cutting means cuts said plural perforation lines in an offset manner with respective ones of said plural registration marks.

19. The apparatus according to claim 16, wherein said printing means prints said plural registration marks substantially centered on respective ones of said plural perforation lines.

20. The apparatus according to claim 16, further comprising means for winding said linerless label stock into a roll.

* * * * *